US010968909B2

(12) United States Patent
North et al.

(10) Patent No.: US 10,968,909 B2
(45) Date of Patent: Apr. 6, 2021

(54) PUMP COMPRISING A PROXIMITY SENSOR

(71) Applicant: Edwards Limited, Burgess Hill (GB)

(72) Inventors: Phillip North, Burgess Hill (GB); Kanstantinos Karoulas, Burgess Hill (GB); Benjamin Raymond Wooller, Burgess Hill (GB); Alan Ernest Kinnaird Holbrook, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 298 days.

(21) Appl. No.: 15/749,884

(22) PCT Filed: Aug. 4, 2016

(86) PCT No.: PCT/GB2016/052393
§ 371 (c)(1),
(2) Date: Feb. 2, 2018

(87) PCT Pub. No.: WO2017/025722
PCT Pub. Date: Feb. 16, 2017

(65) Prior Publication Data

US 2018/0238328 A1 Aug. 23, 2018

(30) Foreign Application Priority Data

Aug. 7, 2015 (GB) ..... 1514001

(51) Int. Cl.
*F04C 18/12* (2006.01)
*F04C 28/28* (2006.01)

(52) U.S. Cl.
CPC ..... *F04C 18/12* (2013.01); *F04C 28/28* (2013.01); *F04C 2240/81* (2013.01); *F04C 2270/17* (2013.01)

(58) Field of Classification Search
CPC ... F04C 2240/81; F04C 2270/17; F04C 28/28
See application file for complete search history.

(56) References Cited

U.S. PATENT DOCUMENTS 6,447,572 B2 * 9/2002 Despreaux ..... F04C 28/28 95/1
2005/0019169 A1 1/2005 Kriehn et al.
(Continued)

FOREIGN PATENT DOCUMENTS

DE 10202361 A1 7/2003
DE 102011101648 A1 11/2012
(Continued)

OTHER PUBLICATIONS

Takao, Machine translation of Japanese Patent Publication of JP 06-330875, Title: Exhaust Pump. (Year: 1994).*
(Continued)

*Primary Examiner* — Mary Davis
(74) *Attorney, Agent, or Firm* — Shumaker & Sieffert, P.A.

(57) ABSTRACT

A dry vacuum pump may include a stator which defines an internal chamber in which a rotor is rotationally mounted. A sensor is mounted to the stator and has an output connected to a processing circuit arranged to analyse the output of the sensor to determine the absolute distance between a point on the surface of the rotor and internal stator surface. The rotor to stator clearance can thus be accurately determined in real time during operation of the pump, so that the pump performance can be optimised over its serviceable life.

22 Claims, 2 Drawing Sheets

(56) References Cited

U.S. PATENT DOCUMENTS

| | | | | |
|---|---|---|---|---|
| 2007/0196228 | A1* | 8/2007 | Tunna | F04C 18/16 418/201.1 |
| 2015/0036150 | A1* | 2/2015 | Kobayashi | G01B 11/24 356/614 |
| 2018/0010604 | A1* | 1/2018 | Voit | F04C 2/1071 |

FOREIGN PATENT DOCUMENTS

| | | | |
|---|---|---|---|
| EP | 1122440 | A1 | 8/2001 |
| EP | 1619395 | A1 | 1/2006 |
| FR | 2812041 | A1 | 1/2002 |
| GB | 1195368 | | 6/1970 |
| JP | H02207187 | A | 8/1990 |
| JP | H06330875 | A | 11/1994 |

OTHER PUBLICATIONS

Heiko, Machine Translation of German Patent Publication DE 102011101648 A1, Title:Screw machine e.g. double-flow screw pump, for pumping of e.g. fluid, has spindles accommodated with profile packages in casing, where fixed gap is formed among spindles and casing, and gap adjustment unit adjusting gap. (Year: 2012).*

Combined Search Report and Examination Report under Sections 17 and 18(3) dated Feb. 19, 2016 in counterpart GB Application GB1514001.5, 9 pp.

Search Report and the Written Opinion dated Oct. 25, 2016 in counterpart International Application No. PCT/GB2016/052393, 13 pp.

Examination Report from counterpart European Application No. 16750226.9, dated Jul. 25, 2019, 4 pp.

* cited by examiner

PUMP COMPRISING A PROXIMITY SENSOR

This application is a national stage entry under 35 U.S.C. § 371 of International Application No. PCT/GB2016/052393, filed Aug. 4, 2016, which claims the benefit of GB Application 1514001.5, filed Aug. 7, 2015. The entire contents of International Application No. PCT/GB2016/052393 and G.B. Application 1514001.5 are incorporated herein by reference.

TECHNICAL FIELD

This disclosure relates to pumps and more particularly but not solely to vacuum pumps.

BACKGROUND

So-called dry vacuum pumps are used in many industrial applications, including the manufacture of semiconductor devices where a benign and clean environment is required in which processing of the semiconductor wafers can be performed. Vacuum environments are known to be sufficient for these processes to be performed without contamination. In use, a dry vacuum pump is used to evacuate a chamber in which the manufacturing process is performed.

Such dry vacuum pumps typically comprise a Roots mechanism, which operates by pumping air with a pair of intermeshing lobed rotors mounted inside a stator. However, other kinds of dry pumping mechanisms can be used, such as hook and claw, Northey, mechanisms or screw mechanisms.

The common feature linking such dry vacuum pumps is that no sealing fluid is used between the stator and rotor(s). Such sealing fluids are undesirable because they can vaporise and migrate into the process chamber and cause contamination of the semiconductor being processed. The efficiency of the pump is thus dependent on maintaining a clearance between the stator and rotor(s) and any intermeshing rotor components within a specific tolerance.

At present, a typical dry vacuum pump relies on good design and manufacturing techniques to keep the clearances between the rotors and stator of the pump within desirable limits and to maintain these clearances throughout the operational cycles of the pump, and as the pump heats up.

SUMMARY

Aspects and embodiments of the present disclosure will now be described with the foregoing in mind.

In accordance with the present disclosure, as seen from a first aspect, there is provided a pump comprising a stator which defines an internal chamber in which a rotor is rotationally mounted, a sensor mounted to the stator and having an output connected to a processing circuit, said circuit being arranged to analyse the output of the sensor to determine the absolute distance between a point on the surface of the rotor and the sensor.

The sensor is set at a known distance away from an internal wall of the chamber and thus the circuit can calculate the distance between the point on the rotor and the wall of the chamber. The circuit may comprise a display which displays the calculated or determined distance in real time.

The present disclosure thus provides for accurate and consistent determination of the rotor to stator clearance during running of the pump, so that the pump performance can be optimised over the serviceable life of the pump. The disclosure has other advantages in that it allows a more accurate determination of the performance of the pump and this can be used to help determine when a service should be performed and which component might need servicing or replacement.

The circuit may be arranged to store a value representative of the optimal distance between the point on the rotor and the wall of the chamber and to display the deviation from the optimal distance.

The circuit may be arranged to produce an output or warning if the calculated distance is outside a predetermined limit.

Preferably, the circuit is arranged to store a value representative of the calculated distance for successive cycles of the rotor and to analyse the stored values. This could be used for example to determine if the distance has started to deviate at an unexpected rate, which might be indicative that a component is about to fail. Alternatively, it could be used to determine if the distance fluctuates or cycles, which might be indicative that vibrations are occurring.

The circuit may be arranged to analyse the output of the sensor to determine the absolute distance between a radially outermost point of the rotor and the sensor.

The circuit may be arranged to analyse the output of the sensor to determine the absolute respective distance between a plurality of points on the rotor and the sensor. This is advantageous if the rotor has a plurality of lobes or other points which might be subject to wear.

The pump may comprise a plurality of sensors arranged at different positions in the chamber, said circuit being arranged to analyse the output of each sensor to determine the absolute distance between a respective point on the surface of the rotor and the sensor. One sensor may enable a radial distance of the rotor to be determined whist another may enable an axial distance to be determined.

The pump stator may define a plurality of internal chambers, a rotor(s) being rotationally mounted in each chamber, a sensor being mounted to the stator adjacent a sidewall of each chamber, said circuit being arranged to analyse the output of each sensor to determine the absolute distance between a point on the surface of the respective rotor and the sensor.

The sensor may be mounted in an adapter which is seated in a bore that extends through the stator towards or into the chamber.

The position of the sensor within the adapter may be adjustable.

The adapter may comprise a datum which registers with a corresponding datum on the stator. The adaptor is located within a datum such that the adaptor is mounted inside the stator wall. The mounting method ensures that the sensor does not project into the chamber and that it cannot foul the rotor.

Also in accordance with the present disclosure, as seen from a second aspect, there is provided a method of analysing the performance of a pump comprising a stator which defines an internal chamber in which a rotor is rotationally mounted, the method comprising mounting a sensor to the stator and analysing, in a processing circuit, the output of the sensor during operation of the pump to determine the absolute distance between a point on the surface of the rotor and the sensor.

The sensor can set at a known distance away from an internal wall of the chamber and thus the method can further calculate the distance between the point on the rotor and the wall of the chamber.

The sensor is preferably a non-contact displacement sensor, for example an Eddy current sensor, capacitive sensor, laser triangulation sensor, confocal sensor and Hall effect sensor.

BRIEF DESCRIPTION OF THE DRAWINGS

Embodiments of the present disclosure will now be described by way of examples only and with reference to the accompanying drawings.

DETAILED DESCRIPTION

FR2812041 discloses a dry vacuum pump of the Roots type in which a proximity sensor is mounted to the stator to detect the axial thermal expansion of the rotor. The signal produced by the sensor is used to control a stator cooling circuit, in order to maintain the axial play of the rotor at a value greater than a minimum admissible value. This is achieved by determining whether the output signal of the sensor is above a predetermined threshold, whereupon an additional cooling circuit is activated.

It will be appreciated however that any moving parts in a dry vacuum pump will be subject to wear and tear and possible external influences, which may cause the pump to fail or operate outside its desired working parameters. It is clearly desirable for the operator of such pumps to know when a pump is likely to fail or is operating outside its desired working parameters.

Unfortunately, it is not possible to accurately predict such occurrences by simply monitoring for a drop in the achieved vacuum, since this can occur for a variety of other reasons, such as restrictions or leaks in the inlet or outlet or the failure of any connected valves or other ancillary devices.

Figure 1:
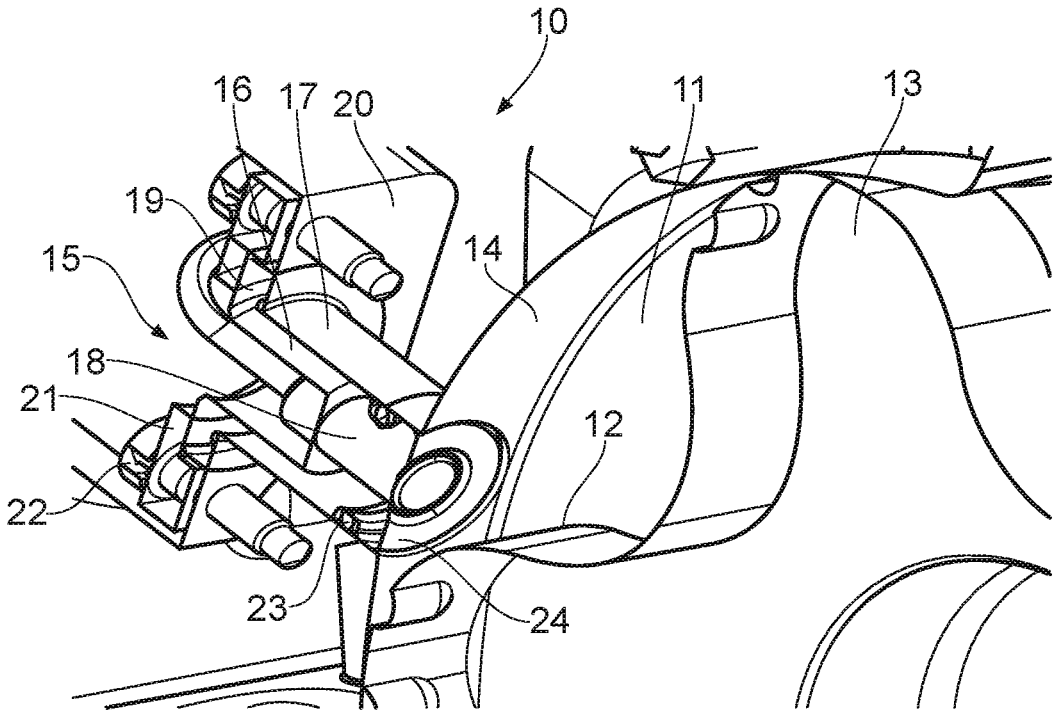
FIG. 1 is a sectional view through a portion of embodiment of dry vacuum pump in accordance with the present disclosure.

Referring to FIG. 1 of the drawings, there is shown an embodiment of dry vacuum pump comprising a stator which defines an internal chamber 11, in which two or more rotors e.g. 12 are mounted for rotation about respective rotational axis. Each rotor 12 comprises a plurality of intermeshing lobes 13 which, in use, come in close proximity to an arcuate internal surface 14 of the side wall of the side wall of the chamber 11 for at least part of their rotational cycle. The lobes 13 are designed to form an effective seal with the arcuate surface 14 of the stator side wall, so as to drive air that is trapped between adjacent lobes 13 from an inlet to an outlet port (not shown) of the pump.

The dry vacuum pump as hereinbefore described is conventional but, in accordance with the present disclosure, further comprises a sensor assembly 15 mounted to the stator 10. The sensor assembly 15 comprises a tubular adaptor 16, which is seated in a bore 17 which extends radially through the side wall of the stator 10 from an external surface to the arcuate internal surface 14 thereof. An O-ring 23 extends around the external tubular surface of the sidewall of the adapter 16 and forms a seal between the adapter 16 and the bore 17.

Figure 2:
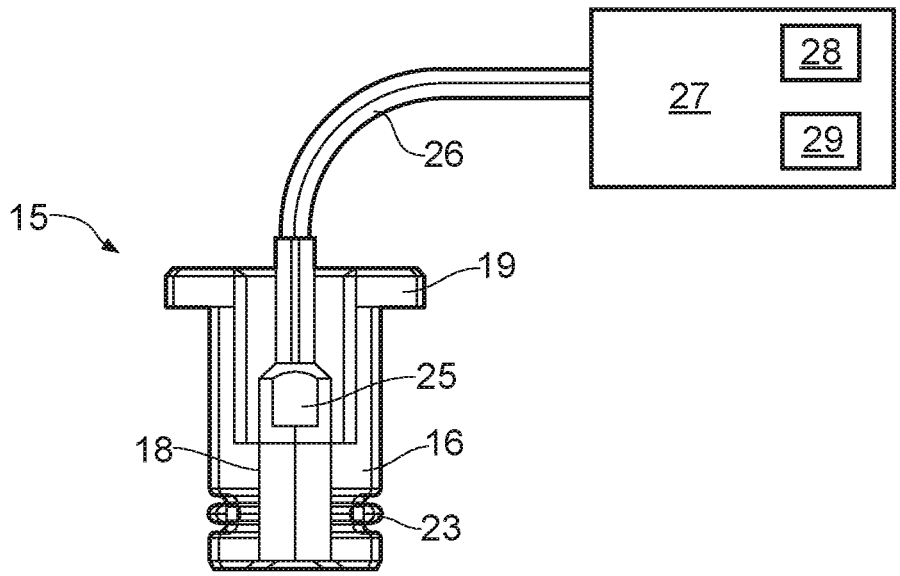
FIG. 2 is a sectional view through a sensor assembly of the dry vacuum pump of FIG. 1.

Referring also to FIG. 2 of the drawings, the sensor assembly 15 further comprises an elongate cylindrical non-contact displacement sensor 18, in this example an Eddy current sensor, mounted axially inside the tubular adaptor 16. The sensor 18 has an external screw thread (not shown) which engages with an internal screw thread (not shown) on the internal tubular surface of the adaptor 16. A sealing and locking compound is preferably disposed around the threads to form a good seal therebetween and lock the sensor 18 in-situ. The sidewall of the proximal end of the sensor 18 comprises a pair of diametrically opposed flat regions 25 which can be engaged by a tool (not shown) inserted into the widened proximal end of the adaptor 16, so that the sensor 18 can be readily inserted into or removed from the adaptor 16 by turning the tool to rotate the sensor 18. A cable 26 extends from the proximal end of the sensor 18 to a detection and processing circuit 27.

The proximal end of the adapter 16 comprises a radially extending flange 19 having a flat under surface which lies in a plane that extends perpendicular to the axis of the adapter 16 and faces towards its proximal end. The external end of the bore 17 in the stator 10 is surrounded by a flat surface 20 which lies in a plane that extends perpendicular to the axis of the bore 17 and faces outwardly. The adapter 16 is clamped to the stator 10 by an apertured collar 21 which is fastened to the stator 10 by bolts 22 and which urges the flat under surface of the flange 19 against the flat surface 20 surrounding the bore 17. The axial length of the adapter 16 from the flat under surface of the flange 19 to its distal end face 24 is arranged to be slightly less than the minimum length of the bore 17, so that the end face 24 is slightly recessed into the arcuate internal surface 14 of the wall of the chamber 11 so as to avoid any risk of the rotor 13 contacting the adapter 16. The distal end face of the sensor 18 is also recessed into the distal end face 24 of the adapter 16 so as to avoid any risk of the rotor 12 contacting the sensor 18.

The hereinbefore mentioned tool can also be used to set the axial position at which the sensor 18 is positioned inside the adaptor 16 prior to fitting the sensor assembly 15 to the stator 10. Positioning the sensor 18 inside the adaptor 16 protects it from accidental damage during assembly and operation of the pump.

In use, the sensor 18 emits an electromagnetic field which generates an opposing field on the target material, in this example the rotor, and produces Eddy currents. The variation in Eddy currents generated on the rotor is detected by the sensor. This variation can then be determined by the circuit 17 to give an absolute value of the distance of the rotor 12 from the sensor 18 and the internal surface 14 of the chamber as it rotates. For example, the distance between the radially outer end of each lobe 13 of the stator and the chamber wall can be determined. The circuit 27 includes a display 28 which may provide this information to the operator in real time. The circuit 27 also includes a memory 29 which stores the distance information for each reference point on the pump, so that the information can be retrieved and analysed by the circuit 27 to give an indication of wear or vibration of the rotor. The circuit 27 may output a warning that the wear has exceeded a predetermined level or that vibrations are occurring, so that the operator can make an accurate determination of the performance of the pump and when a service might be needed, even which component might need servicing or replacement.

Figure 3:
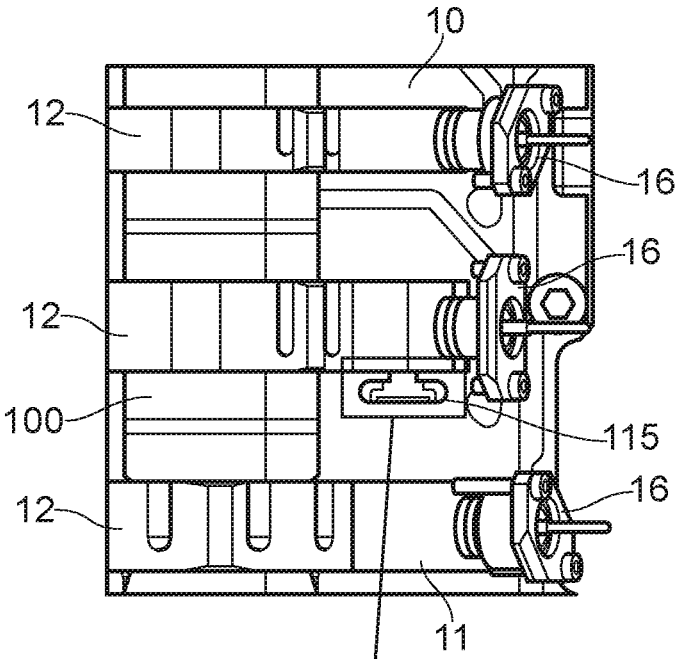
FIG. 3 is a sectional view through a portion of alternative embodiment of dry vacuum pump in accordance with the present disclosure.

Referring to FIG. 3 of the drawings, there is shown an alternative embodiment of dry vacuum pump which is similar to the pump of FIGS. 1 and 2 and like parts are given like reference numerals. The pump comprises a stator 10 which defines a plurality of internal chambers e.g. 11 in which two or more rotors e.g. 12 are respectively mounted for rotation about respective rotational axis. The like rotors 12 of each chamber 11 are mounted to a common shaft 100 at different rotational positions to each other. Radial sensor assemblies 16 of the kind described in FIGS. 1 and 2 are arranged to monitor the position of the radial face of each rotor 12. Each rotor 12 also comprises opposite flat axial faces in close proximity to the respective flat side walls of the chamber 11 in which they are mounted and it can be important to also monitor this distance to detect wear.

Figure 4:
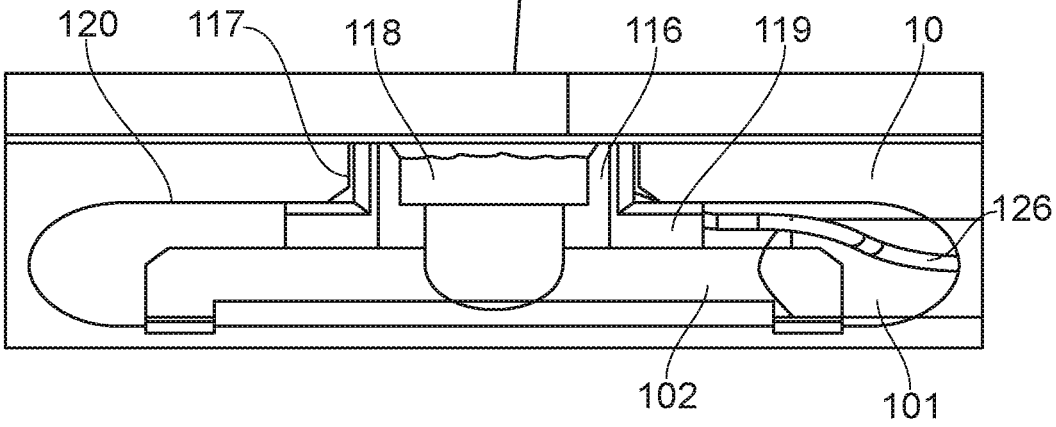
FIG. 4 is an enlarged view of a part of the dry vacuum pump of FIG. 3 illustrating a sensor mounting arrangement.

Referring also to FIG. 4 of the drawings, the pump further comprises an axial sensor assembly 115 mounted inside a cavity 101 formed adjacent a flat side wall of the chamber 11 in the stator 10. The sensor assembly 115 comprises a tubular adaptor 116, which is seated in a bore, in the form of a slot, 117 which extends from the cavity 101 axially through the side wall of the stator 10 to the flat internal surface thereof.

The sensor assembly 115 further comprises a non-contacting displacement sensor 118, in this example an Eddy current sensor 118, sealingly mounted axially inside the tubular adaptor 116. A cable 126 extends from the proximal end of the sensor 118 to a detection and processing circuit.

The proximal end of the adapter 116 comprises a radially extending flange 119 having a flat under surface which lies in a plane that extends perpendicular to the axis of the adapter 116 and faces towards its proximal end. The external end of the bore 117 in the stator 10 is surrounded by a flat internal surface 120 of the cavity 101, which lies in a plane that extends perpendicular to the axis of the bore 117. The adapter 116 is clamped to the stator 10 by spring member 102 which acts between the opposite flat internal surface of the cavity 101 and the proximal end of the adapter 116 to urge the flat under surface of the flange 119 against the flat surface 120 surrounding the bore 117. The axial length of the adapter 116 from the flat under surface of the flange 119 to its distal end face is arranged to be slightly less than the axial length of the bore 117, so that the end face of the sensor 118 is slightly recessed into the flat axial surface of the wall of the chamber 11 so as to avoid any risk of the rotor 12 contacting the adapter 116. The distal end face of the sensor 118 is also recessed into the distal end face of the adapter 116, so as to avoid any risk of the rotor 13 contacting the sensor 118.

In use, the axial sensor 118 emits an electromagnetic field which generates an opposing field on the target material, in this example the rotor 12, as it rotates which produces Eddy currents. This variation in the Eddy currents can then be determined by the circuit to give an absolute value of the distance axial side face of the rotor 12 from the sensor 18 and the flat axial surface of the wall of the chamber 11 as it rotates. This information can be used to determine wear of the rotor 12 and any axial movement in the shaft 100.

A similar axial sensor assembly may be mounted in each chamber 11 and/or in opposite flat axial surfaces of the wall of the or each chamber 11.

A pump in accordance with the present disclosure can provide an accurate and consistent determination of the rotor to stator clearance during operation of the pump to optimise pump performance over the serviceable life of the pump. The disclosure has other advantages in that it can be used to help determine when a service should be performed allowing more accurate determination of the performance of the pump and when a service might be needed

The invention claimed is:

1. A pump comprising:

a stator which defines an internal chamber in which a rotor is rotationally mounted;

a processing circuit; and a sensor mounted to the stator and connected to the processing circuit, the processing circuit being configured to:

analyse an output of the sensor to determine an absolute distance between a point on a surface of the rotor and the sensor;

store a value representative of the absolute distance for successive cycles of the rotor; and analyse the stored values to determine at least one of:

a rate at which the absolute distance is deviating from a predetermined value; or a fluctuation or cycle in the absolute distance; and output a warning that the rate, fluctuation, or cycle has exceeded a predetermined level.

2. The pump as claimed in claim 1, wherein the sensor is set a known distance away from an internal wall of the internal chamber, the processing circuit being configured to calculate the absolute distance between the point on the surface of the rotor and the internal wall of the internal chamber.

3. The pump as claimed in claim 2, wherein the processing circuit is configured to store a value representative of an optimal distance between the point on the surface of the rotor and the internal wall of the internal chamber and to display a deviation of the absolute distance from the optimal distance.

4. The pump as claimed in claim 1, wherein the processing circuit comprises a display which displays the absolute distance in real time.

5. The pump as claimed in claim 1, wherein the processing circuit is configured to produce an output or warning if the absolute distance is outside a predetermined limit.

6. The pump as claimed in claim 1, wherein the processing circuit is configured to analyse the output of the sensor to determine the absolute distance between a radially outermost point of the rotor and the sensor.

7. The pump as claimed in claim 1, wherein the processing circuit is configured to analyse the output of the sensor to determine respective absolute distances between a plurality of points on the rotor and the sensor.

8. The pump as claimed in claim 1, further comprising a plurality of sensors arranged at different positions in the internal chamber, the processing circuit being configured to analyse an output of each respective sensor of the plurality of sensors to determine a respective absolute distance between a respective point on the surface of the rotor and the respective sensor.

9. The pump as claimed in claim 1, wherein the processing circuit is configured to analyse the output of the sensor to determine an absolute radial distance between the point on the surface of the rotor and the sensor.

10. The pump as claimed in claim 1, wherein the processing circuit is arranged to analyse the output of the sensor to determine an absolute axial distance between the point on the surface of the rotor and the sensor.

11. The pump as claimed in claim 1, wherein the pump stator defines a plurality of internal chambers, a rotor being rotationally mounted in each chamber, a respective sensor being mounted to the stator adjacent a sidewall of each chamber, the processing circuit being configured to analyse an output of each sensor to determine a respective absolute distance between a point on the surface of the respective rotor and the respective sensor.

12. The pump as claimed in claim 1, wherein the sensor is mounted in an adapter which is seated in a bore that extends through the stator towards or into the internal chamber.

13. The pump as claimed in claim 12, wherein the position of the sensor within the adapter is adjustable.

14. The pump as claimed in claim 13, wherein the adapter comprises a datum which registers with a corresponding datum on the stator.

15. The pump according to claim 1 wherein the sensor is a non-contact displacement sensor chosen from at least one of an Eddy current sensor, a capacitive sensor, a laser triangulation sensor, a Hall effect sensor, or a confocal sensor.

16. A method of analysing the performance of a pump comprising a stator which defines an internal chamber in which a rotor is rotationally mounted, the method comprising:

mounting a sensor to the stator; and analysing, in a processing circuit, an output of the sensor during operation of the pump to determine an absolute distance between a point on a surface of the rotor and the sensor;

storing a value representative of the absolute distance for successive cycles of the rotor; and analysing the stored values over time to determine at least one of:

a rate at which the absolute distance is deviating from a predetermined value; or a fluctuation or cycle in the absolute distance; and outputting a warning that the rate, fluctuation, or cycle has exceeded a predetermined level.

17. The method as claimed in claim 16, further comprising:

setting the sensor at a known distance away from an internal wall of the internal chamber; and calculating the absolute distance between the point on the rotor and the internal wall of the internal chamber.

18. The method as claimed in claim 16, further comprising displaying the absolute distance in real time.

19. The method as claimed in claim 16, further comprising:

storing, in the processing circuit, a value representative of an optimal distance between the point on the rotor and the internal wall of the internal chamber; and displaying a deviation of the absolute distance from the optimal distance.

20. The method as claimed in claim 16, further comprising outputting a warning if the absolute distance is outside a predetermined limit.

21. The method as claimed claim 16, further comprising analysing the output of the sensor to determine the absolute distance between a radially outermost point of the rotor and the sensor.

22. The method as claimed claim 16, further comprising analysing the output of the sensor to determine respective absolute distances between a plurality of points on the rotor and the sensor.

* * * * *